US006765453B2

(12) United States Patent
Yamaguchi et al.

(10) Patent No.: US 6,765,453 B2
(45) Date of Patent: Jul. 20, 2004

(54) NON-RECIPROCAL CIRCUIT DEVICE HAVING A THERMAL CONDUCTOR

(75) Inventors: Shuichiro Yamaguchi, Miyazaki (JP); Hiromi Tokunaga, Miyazaki (JP); Munenori Fujimura, Miyazaki (JP); Hitoshi Uchi, Miyazaki (JP); Hiroshi Kawano, Miyazaki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 134 days.

(21) Appl. No.: 10/114,840

(22) Filed: Apr. 2, 2002

(65) Prior Publication Data

US 2002/0185659 A1 Dec. 12, 2002

(30) Foreign Application Priority Data

Apr. 4, 2001 (JP) ..... 2001-105465
Jul. 3, 2001 (JP) ..... 2001-201648

(51) Int. Cl.[7] ..... H01P 1/36
(52) U.S. Cl. ..... 333/24.2; 333/1.1
(58) Field of Search ..... 333/1.1, 24.2

(56) References Cited

U.S. PATENT DOCUMENTS 4,236,125 A * 11/1980 Bernard et al. ..... 333/1.1

FOREIGN PATENT DOCUMENTS

| | | |
|---|---|---|
| EP | 0948079 A1 * | 10/1999 |
| JP | 02-55403 | 2/1990 |
| JP | 10-261904 | 9/1998 |

* cited by examiner

*Primary Examiner*—Robert Pascal
*Assistant Examiner*—Stephen E. Jones
(74) *Attorney, Agent, or Firm*—RatnerPrestia

(57) ABSTRACT

A compact non-reciprocal circuit device capable of handling a high power without impairment of the characteristics. The non-reciprocal circuit device contains a magnetic substrate that exhibits anisotropic behavior by application of a direct-current magnetic field. On the surface of the substrate, strip-lines are disposed at an angle, being insulated with each other. One end of each strip-line is grounded, and the other end of each is connected through a capacitor to a ground. Of the ends connecting the capacitors, one end connects to a termination resistor; the remaining ends connect each to an input terminal and an output terminal. The non-reciprocal circuit device exhibits non-reciprocal characteristics between the input and output terminals. The case of the device contains an insulating thermal conductor that serves as a heat-radiator for the termination resistor and the strip-lines.

16 Claims, 7 Drawing Sheets

NON-RECIPROCAL CIRCUIT DEVICE HAVING A THERMAL CONDUCTOR

FIELD OF THE INVENTION

The present invention relates to a non-reciprocal circuit device employed for mobile communications equipment including a automobile phone and a cellular phone used in ultrahigh or microwave frequency bands, more particularly, relates to a non-reciprocal circuit device capable of handling high electric power.

BACKGROUND OF THE INVENTION

Manufacturers have long recognized the merit of a non-reciprocal circuit device because of its compact structure, and have used it in a terminal for mobile communications.

In the non-reciprocal circuit device, as shown in FIG. 9, a signal entered from an input terminal, which travels in a forward direction, passes through a low-loss route to an output terminal. On the other hand, as shown in FIG. 10, a signal entered from an output terminal, which travels in a reverse direction, passes through a route different from aforementioned one and reaches a different terminal, at which the signal is absorbed in a termination resistor connected with the terminal. That is, the non-reciprocal circuit device has the characteristics: if an output terminal reflects signals entered from an input terminal, very few of the signals return to the input terminal. In a transmission stage of mobile communications equipment, a non-reciprocal circuit device is placed between a power amplifier and an antenna. This arrangement is useful to avoid that reflected waves from the antenna flow back into the power amplifier, or to stabilize the load impedance of the power amplifier.

FIG. 11 shows a typical structure of the non-reciprocal circuit device that has been widely used in a terminal for a cellular phone terminal.

Here will be briefly described the structure with reference to the accompanying drawings.

Magnetic circular plate 55 is made of ferrite and is disposed facing magnet 52, so that an appropriate direct-current magnetic field can be applied to plate 55. Under the arrangement, plate 55 exhibits anisotropic behavior for a radio frequency (rf) electromagnetic field. Three strip-lines 54*a*, 54*b*, and 54*c* are disposed adjacent to magnetic circular plate 55 in such a manner that each strip-line lies on another to cross each other at an angle of approximately 120°. Each of the strip-lines is electrically insulated by insulating sheet 56. Ends 54*d* and 54*e* of strip-lines 54*a* and 54*b* are connected to input terminal 53*a* and output terminal 53*b*, respectively, of terminal base 53. At the same time, ends 54*d* and 54*e* connect through matching capacitors 58*a* and 58*b*, respectively, to the ground. One end of strip-line 54*c* connects through the parallel arrangement of matching capacitor 58*c* and termination resistor 57 to the ground.

Other ends of each strip-line connected to a circular ground-plate (not shown) are further electrically connected, together with impedance-matching capacitors 58*a*, 58*b*, 58*c* and the ground-side electrodes of termination resistor 57, to lower case 59 and are grounded. Magnetic circular plate 55 and magnet 52 covered with upper case 51 and lower case 59 form into a magnetic circuit.

In the non-reciprocal circuit device having the structure above, a radio frequency signal entered from input terminal 53*a* travels through strip-line 54*a*, plate 55, and strip-line 54*b* to output terminal 53*b* as an output signal with low-loss.

On the other hand, an rf-signal entered from output terminal 53*b* travels through strip-line 54*b*, plate 55, and strip-line 54*c* to terminal 54*f* The rf-signals, due to its traveling in a reverse direction, are absorbed by termination resistor 57, so that there are few to back to input terminal 53*a*. The non-reciprocal circuit device thus exhibits the irreversible behavior.

As the recent widespread use of mobile communications, mobile communications equipment has been showing size and cost reductions, at the same time, consuming higher power. This trend is also true for base stations: the non-reciprocal circuit device used for a base station is often operated at around maximum power rating. With the prior-art structure, however, the non-reciprocal circuit device is overheated by a surge of high power. Countermeasures against the undesired heat, for example, are disclosed in Japanese Patent Laid-open No. H02-55403 and H10-261904: in the former one, two or more film-resistors are used as a resistor to distribute the heat; in the latter, two or more chip resistors are used as a resistor and heat generated at the chip resistors is transferred from the ground-side terminal of the chip resistors to the case. In either method, however, the temperature of the resistor still reaches extremely high when high power surges into the resistor.

SUMMARY OF THE INVENTION

It is therefore the object of the present invention to provide a high-power and small-sized non-reciprocal circuit device without impairment of the capability.

According to the present invention, non-reciprocal circuit device includes: a magnetic substrate; a magnet applying a magnetic field to the substrate; strip-lines disposed in a crossing arrangement at an angle with each other on the substrate, with each strip-line electrically insulated; capacitors connected to the strip-lines; a termination resistor connected to one of the strip-lines; a case accommodating the components above; and a thermal conductor disposed in the case. In the non-reciprocal circuit device, the thermal conductor radiates heat generated in at least one of the termination resistor and the strip-lines.

It is thus possible to provide a high-power acceptable non-reciprocal circuit device, without impairment of the advantages—having a shrunk body with low-loss.

Furthermore, the non-reciprocal circuit device has the merits listed below:

(1) transferring at least a part of heat generated at the termination resistor or the stlip-lines, through the thermal conductor, to at least a part of the component can bring effective heat-radiation.

(2) forming an insulating material into the thermal conductor allows the conductor to come in contact with a conductive component—this increases design flexibility.

(3) disposing the thermal conductor close to, or in contact with the termination resistor or the stlip-lines can bring more effective heat-radiation.

(4) forming a material having flexibility or elasticity into the thermal conductor allows the conductor to be altered into a desired shape to fit within the case, which brings an intimate contact between the circuit components, with the result of obtaining effective heat-radiation. In addition, a step of adjusting the spacing between the components can be eliminated from assembly work, thereby increasing productivity.

(5) forming a resin material into the thermal conductor allows the conductor to be easily and properly housed into the case with no ill effect on electric characteristics. At the same time, such a material enhances fire retardation of the structure.

(6) forming thickly the thermal conductor on the termination resistor allows the conductor to have greater heat capacity, thereby offering effective heat-radiation.

(7) disposing the thermal conductor so as to make contact with the magnet or a part of the case can transfer heat through the case having a greater heat-radiation effect.

(8) forming an adhesive material into the thermal conductor allows the conductor to be fixed in the case.

(9) forming a solid or properly viscous material into the thermal conductor protects the conductor from being extruded from the case, thereby having no ill effect on other circuits.

(10) disposing, in the case, the terminal base that contains at least input and output terminals and a portion accommodating the substrate, and that has a structure keeping the termination resister exposed—this will make positioning of the substrate and mounting of the thermal conductor really simple.

(11) forming the terminal base into a shape having an opening in part, that is, into the general shape of "C", and placing the substrate at the central part of the "C"—this will easily keep room for mounting two or more termination resistors and for disposing the thermal conductor therein.

(12) determining the volume of the insulating thermal conductor in the range from 2% to 75% of the volume of the case offers good heat-radiation effect.

(13) filling spaces of the case with the thermal conductor increases the heat-radiation effect.

DESCRIPTION OF THE PREFERRED EMBODIMENTS

The Preferred Embodiment

A prior-art non-reciprocal circuit device operates at a power of approximately 2.5 W for forward-direction input, and approximately 0.6 W for reverse-direction input. Preferably, however, the operating power for forward-direction input should be increased to approximately 5 W. The non-reciprocal circuit device of the present invention can increase the operating power to approximately 5 W for forward-direction input without sacrificing of its shrunk structure and low-insertion loss characteristics.

When an adequate direct-current magnetic field is applied to some magnetic substance such as ferrite, the magnetic substance acts as an anisortopic medium for a radio-frequency (rf) electromagnetic field, and the rf signal fed into the substance travels in a direction different from the incident direction—the non-reciprocal circuit device of the present invention takes advantage of the characteristics above.

The preferred embodiment of the present invention is described hereinafter with reference to the accompanying drawings.

Figure 1:
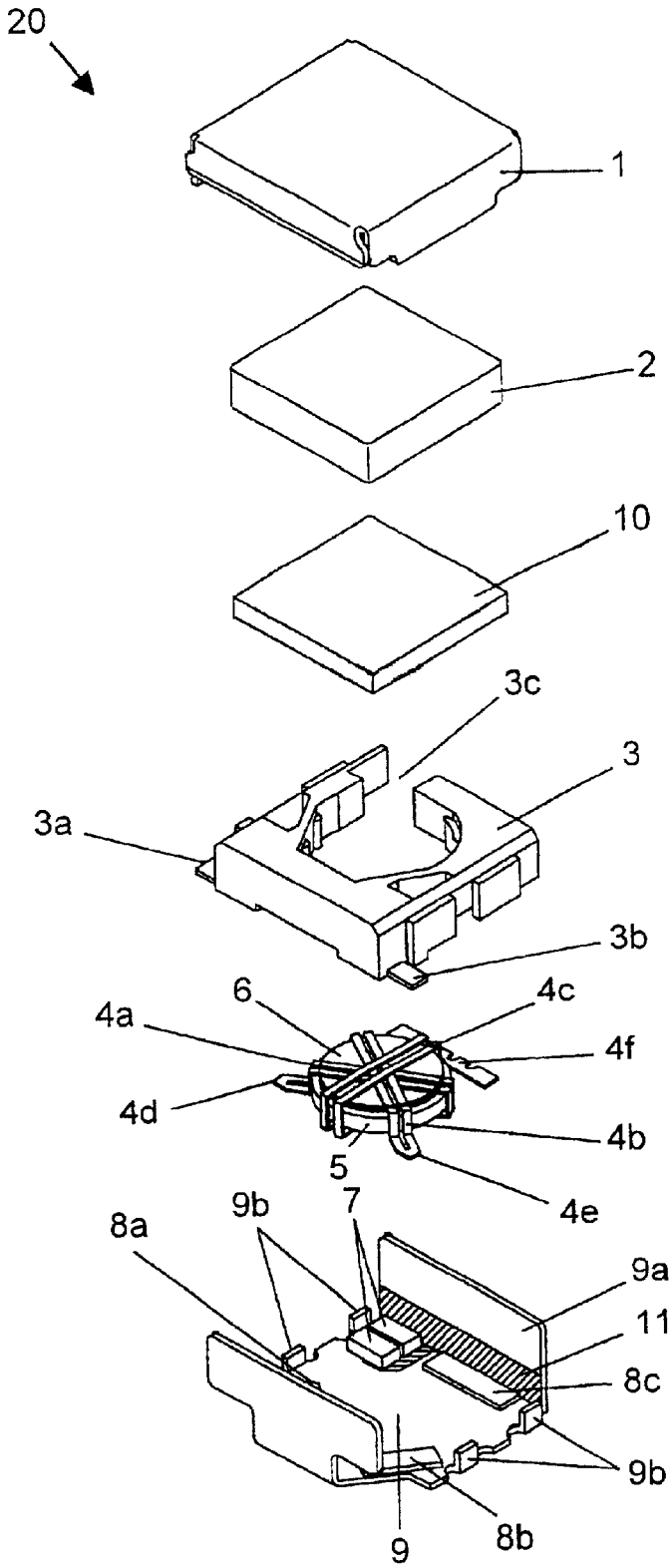
FIG. 1 is an exploded perspective view of the non-reciprocal circuit device of the preferred embodiment of the present invention.

FIG. 1 is an exploded perspective view of the non-reciprocal circuit device of the preferred embodiment of the present invention. Magnetic substrate 5 is made of ferrite. Strip-lines 4*a*, 4*b*, and 4*c* run along the upper and the side surfaces of substrate 5. Each one end of the strip-lines extends to the lower surface of substrate 5 to make contact with the bottom of lower case 9 and a ground-plate disposed at the lower surface of substrate 5. Each strip-line is electrically insulated from each other by insulating sheet 6. Each one electrode of termination resistor 7 and matching capacitors 8*a*, 8*b*, 8*c* is connected with lower case 9 as the ground electrode.

The remaining electrodes of capacitors 8*a* and 8*b* are connected to terminal portions 4*d* and 4*e*, respectively, which are disposed at the other ends of the strip-lines. Furthermore, input terminal 3*a* and output terminal 3*b* are connected with terminal portions 4*d* and 4*e*, respectively. Each remaining electrode of matching capacitor 8*c* and termination resistor 7 connects with terminal portion 4*f*. Input terminal 3*a* and output terminal 3*b* are provided with terminal base 3. Terminal base 3 is fixed to lower case 9 in such a way that terminal portions 4*d*, 4*e*, and 4*f* have a secure contact with electrodes 8*a*, 8*b*, and 8*c* of matching capacitor, respectively. The components mentioned above are thus connected.

Magnet 2, which applies a direct-current magnetic field to substrate 5, is fixed to upper cover 1, as shown in FIG. 1. Sandwiching insulating thermal conductor 10 between upper cover 1 and lower case 9 to which terminal base 3 is fixed to assemble a non-reciprocal circuit device.

Figure 2:
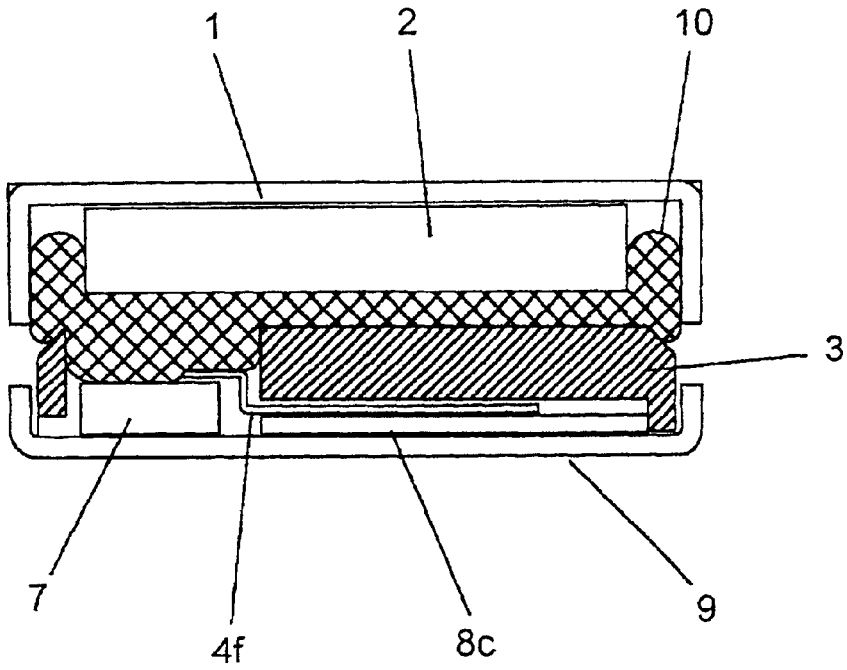
FIG. 2 is a sectional view of the non-reciprocal circuit device of the embodiment.

For good heat-radiation effect, it is preferable to form thermal conductor 10 into a shape having an intimate contact with termination resistor 7, for example, forming the portion that comes into contact with resistor 7 so as to have bigger volume than that of other portions of thermal conductor 10, to be more specific, forming the portion disposed on resistor 7 thicker than other portions. FIG. 2 is a sectional view of the preferable example described above. The non-reciprocal circuit device of the present invention is a typical lumped-constant type isolator.

Hereinafter will be given detailed explanations of each component of the embodiment.

1. Thermal Conductor (1) Materials

For thermal conductor 10, the material should be soft and insulating one with high thermal conductivity. For example, i) an oil compound—alumina powder-contained grease; ii) condensation-type silicon room temperature vulcanizing (RTV) rubber—the substance that hardens and becomes adhesive by reaction with moisture in the air; iii) addition-type silicon rubber/gel—the thermosetting substance that belongs to one-part type or two-part type. With the soft material mentioned above, thermal conductor 10 can be easily changed its shape by stress between other components in the circuit device, fitting securely in the case. At the same time, thermal conductor 10, by its softness, can snugly contact with other components, and conveniently expands in the spaces in the non-reciprocal circuit device.

When grease is employed for thermal conductor 10, the material preferably should be viscous—under the temperature not higher than 150°—to an extent so that thermal conductor 10 can stay itself within the device, not escaping from the case. A sheet type material is also acceptable. In contrast, it is not preferred to use materials that would cause a substantial stress on the circuit components in its hardening process, thereby deteriorating preferable characteristics of the device or breaking up the connection between the components.

Taking electrical characteristics and fire retardation into account, the best selection is a resin material, such as silicon rubber with a thermal conductivity beyond 1 W/m·° C.

Thermal conductor 10 may be made of a non-insulating material. In this case, insulating material such as an insulating film should be sandwiched between thermal conductor 10 and termination resistor 7 or strip-lines 4*a*, 4*b*, 4*c*.

(2) Preferable Placement

Thermal conductor 10 should be close to, or have a contact with termination resistor 7. Since termination resistor 7 gives off greater heat than other components, the placement in which the thermal conductor being disposed as close as possible to the resistor increases the surface area of resistor 7 with which thermal conductor 10 is in contact, thereby protecting the resistor from being overheated beyond a predetermined temperature. Although the predetermined temperature depends on the specifications and size of a device, the embodiment determines the borderline at 130° C.

As described above, increasing the thickness or volume of thermal conductor 10 placed on resistor 7 can lead to absorbing heat from the resistor, protecting the device from overheating.

The placement in which thermal conductor 10 makes contact with magnet 2, lower case 9, or upper cover 1 is further effective in escaping heat out of the case.

It is also possible that thermal conductor 10 is sandwiched between the component members in the non-reciprocal circuit device. In such a placement, two or more thermal conductors can be simultaneously used regardless of the shape of the thermal conductor. When the thermal conductor is made of sheet type material, it is possible to use the conductor as a multi-layered structure.

Employing the thermal conductor that has adhesion or has an adhesive layer thereon facilitates the positioning and fixing of the circuit components in the device. In addition, the adhesion allows the thermal conductor to be steady against physical shocks to the device, thereby each component can work with no deterioration in its characteristics. Employing an adhesive, instead of an adhesive layer, can bring the similar effect.

The ideal placement from a manufacturing viewpoint is the one in which thermal conductor 10 is sandwiched between magnet 2 and substrate 5. Besides, thermal conductor 10 is preferably disposed close to, or making contact with strip-lines 4*a*, 4*b*, and 4*c*. Strip-lines 4*a*, 4*b*, and 4*c* give off heat since they carry a large rf current therethrough. Therefore, escaping the heat generated at the strip-lines through closely disposed thermal conductor 10 protects the non-reciprocal circuit device from having undesired temperature rise.

(3) Dimensions and Structure

Figure 3:
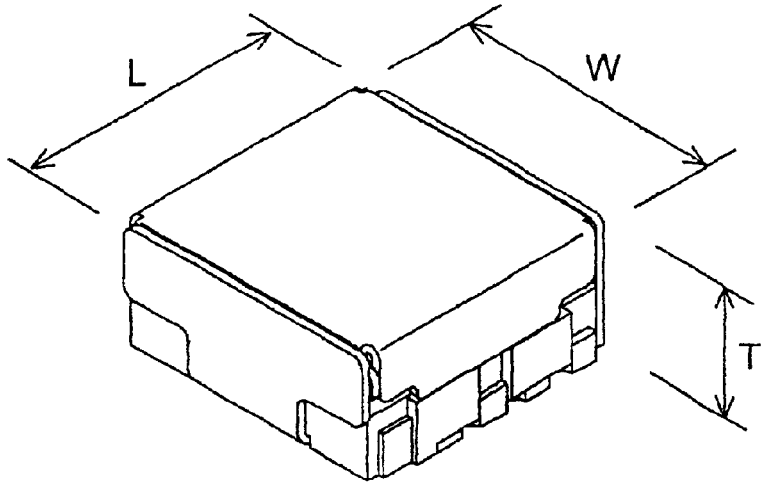
FIG. 3 shows the outer dimensions of the non-reciprocal circuit device.

The volume of thermal conductor 10 should preferably ranges from not less than 2% to not greater than 75% of the volume (given by L×W×T in FIG. 3) of the non-reciprocal circuit device. The thermal conductor having such dimensions comfortably comes into contact with resistor 7 and magnet 2 with no degradation in performance of circuit device, realizing a greater heat-radiation. More preferably, the volume of the thermal conductor should range from 10% to 50% of that of the device—ideally, from not less than 16% to not greater than 50%. The thermal conductor having dimensions above can offer a greater heat-radiation effect with no degradation in performance of circuit device.

As described above, if resistor 7 gives off unusual heat caused by an application of a large current, insulating thermal conductor 10 disposed in the device can distribute the heat through other components, which protects the irreversible circuit component from being damaged. Suppose that an antenna of communications equipment gets damaged and through which a large current as a reflected wave from the antenna flows into the non-reciprocal circuit device. Even in the case, the thermal conductor can properly radiate heat to suppress an abnormal temperature-rise of the resistor. Therefore, the non-reciprocal circuit device structured above can protect an amplifier connected thereto, such as an operational amplifier, from being damaged due to an over current.

2. Strip-lines (1) Materials and Dimensions

Preferably, strip-lines 4*a*, 4*b*, and 4*c* should be made of metal—typified by copper, gold, and silver—processed into a predetermined sheet form. More particularly, employing copper, alloys of copper, or copper added the doping constituents in the required amounts not only takes full advantages of electrical characteristics of the structure, but also contributes to an easily processed, economical product. To be more specific, when rolled copper film is employed, the thickness of the film should range from 25 μm to 60 μm: a thickness not greater than 25 μm lowers the productivity due to a break in the film, whereas a thickness not less than 60 μm can be an obstacle to a low-profile device. The rolled copper film, which is given plating of conductive metal including silver and gold, with a thickness ranging from 1 μm to 5 μm is suitable for the material to increase the conductivity of the surface of the strip-line, providing the device with low-insertion loss.

(2) Shape

Although strip-lines 4*a*, 4*b*, and 4*c* of the embodiment (not shown) are integrated at the middle of each strip-line so as to be generally Y-shaped, they can be separately formed. As described earlier, strip-lines 4*a*, 4*b*, and 4*c* are insulated from each other by insulating sheet 6.

When strip-lines 4*a*, 4*b*, 4*c* are placed around substrate 5, each one end of the strip-lines extended from the circular ground-plate is bent along the side of the substrate. Similarly, each remaining end of the strip-lines is bent along the opposite side. Such a structure can increase filling factor of magnetic field—a degree of the electromagnetic coupling between the strip-lines and the magnetic substrate—as preferably high as possible, thereby reducing insertion loss of the non-reciprocal circuit device in the process of downsizing.

Although the structure of the embodiment contains three strip-lines 4*a*, 4*b*, and 4*c*, the structure with four or more strip-lines can offer the same effect.

3. Magnetic Substrate (1) Materials

Magnetic substrate 5 is preferably made of a magnetic material containing, for example, iron (Fe), yttrium (Y), aluminum (Al), and gadolinium (Gd).

(2) Shape and Dimensions

Substrate 5 can be shaped into a circular, rectangular, oval, or polygonal plate. Above all, from the viewpoint of taking full advantage of characteristics, circular shape will be the best.

Considering the characteristics of the material and required strength, substrate 5 should have a thickness ranging from 0.2 mm to 0.8 mm, preferably, 0.3 mm to 0.6 mm, which is typically thicker than the matching capacitor's. The size of substrate 5 should, from the viewpoint of downsizing and taking full advantage of characteristics, range from 1.6 mm to 3.5 mm in diameter (when the substrate is shaped into circular), preferably, from 2.5 mm to 2.9 mm.

(3) Process and Treatment

Before placing the strip-lines around substrate 5, the edges of the substrate should be properly relieved by chamfering. The treatment will minimize a break of the strip-line and degradation of characteristics due to friction between the substrate and the strip-lines. Polishing process provides substrate 5 with a desired thickness and minimized variations in characteristics.

4. Magnet (1) Materials

Magnet 2 should have a black color so as to obtain a clear image-recognition during assembling. Besides, it is important to select a magnet whose magnetic force can offer a sufficiently strong direct-current magnetic field, which is applied to substrate 5. Considering this, strontium ferrite is a preferable material.

(2) Shape and Dimensions

Magnet 2 can be shaped into a circular, rectangular, oval, or polygonal plate. Especially when circular-shaped substrate 5 is employed, rectangular-shaped magnet 2 is a correct choice from the reason that such shaped magnet can evenly offer a magnetic field over substrate 5 and can be easily positioned with respect to the substrate.

Magnet 2 should be sized bigger than substrate 5 and substrate 5 should fit within the projected area of magnet 2. From the viewpoint of taking full advantage of characteristics, the arrangement in which the center of magnet 2 exactly matches that of substrate 5 should be the best, allowing magnet 2 to apply a magnetic field evenly to substrate 5.

As for the thickness of magnet 2, it should range from 0.3 mm to 1.5 mm from the viewpoint of strength of applied magnetic field and downsizing the device.

5. Case

Lower case 9 and cover 1 serve as the case of the non-reciprocal circuit device of the present invention.

(1) Lower Case

Lower case 9 should be made of a metal with high conductivity: a conductive metallic plate including copper, silver, and iron. From the viewpoint of achieving good electrical characteristics and good connectivity with other components, the lower case should be made of such conductive metallic plate over which a metallic material with high conductivity—for example, silver and gold—is plated in a thickness of 1 $\mu$m to 5 $\mu$m. Lower case 9 contains wall portion 9*a* and projections 9*b*. Projections 9*b* can serve as ground terminals.

Insulator 11, which is disposed on the hot terminal-side of resistor 7 and is on the inner side wall of the lower case at which matching capacitors 8*a*, 8*b*, and 8*c* are proximately disposed. Insulator 11 should be formed at least one of i) an adhesive sheet, ii) a non-adhesive sheet, and iii) a printed insulating film.

Lower case 9 connects, through conductive connecting members, to at least the ground conductor of strip-lines 4*a*, 4*b*, and 4*c*. Lower case 9 is formed into a box-shape having no adjusting apertures.

(2) Upper Cover

Upper cover 1 is made of the material similar to that of lower case 9. Like lower case 9, upper cover 1 has no adjusting apertures. At least magnet 2 is attached on the inner face of upper cover 1 by connecting members.

6. Termination Resistor

In terms of downsizing and simple mounting, a fixed chip resistor is suitable for termination resistor 7. When employing a parallel arrangement of two or more resistors, a chip resistor array should be employed for reducing the number of parts for mounting.

7. Matching Capacitor

From the viewpoint of minimizing variations in capacitance and of encouraging downsizing, especially low-profiled downsizing of the non-reciprocal circuit device, a parallel-plate capacitor should be employed for matching capacitors 8*a*, 8*b*, and 8*c*.

The electrodes of the capacitor should be made of at least one of copper, silver, and nickel. Although each of matching capacitors 8*a*, 8*b*, and 8*c* should have a rectangular face in terms of an effective mounting and proper positioning, it should not always, but a circular-, or oval-shaped resistor is also acceptable.

8. Terminal Base (1) Materials

Terminal base 3 should be made of a non-conductive material including resins—an epoxy resin and a liquid crystal polymer—and ceramics. On the other hand, input terminal 3*a* and output terminal 3*b* (will be mentioned later) should be made of a conductive material including brass, over which a metal with good conductivity, typified by silver, is plated. When mounted on a circuit board with connecting members, the terminal base usually experiences an application of heat. Considering this, terminal base 3 should be made of a material capable of resisting high temperatures exceeding 250° C., preferably, 290° C.

(2) Shape and Structure

Forming terminal base 3 has the advantage of securely holding magnetic substrate 5 in a partially "walled-in" area. Input and output terminals 3*a*, 3*b* are disposed on the terminal base by insert molding. Such a structure offers a fixed arrangement of substrate 5, strip-lines 4*a* through 4*c*, and input and output terminals 3*a*, 3*b*, thereby minimizing variations in characteristics and improving productivity.

Having a general shape of "C", terminal base 3 partially surrounds substrate 5. From the reason that thermal conductor 10 should be placed close to resister 7, the opening of the "C" should have the frontage of greater than 10% of the entire length (circumference) of the "C". On the other hand, in terms of easily positioning substrate 5, input terminal 3*a*, and output terminal 3*b*, and of reserving enough area in terminal base 3 to form input and output terminals 3*a*, 3*b*, the opening should have the frontage of less than 50% of the entire length. To be more specific, it is preferable to maintain the opening-ratio from 10% to 25%. The structure with the opening above can properly applies a pressing force onto the connected point of terminal portions 4*d*, 4*e*, 4*f* of strip-lines 4*a*, 4*b*, 4*f* and matching capacitors 8*a*, 8*b*, 8*c*, respectively, thereby minimizing a connection failure during assemble work.

When terminal base 3 is made of a resin, which offers poor conductivity, consideration should be given to effective radiating of heat. In this case, two or more openings should be formed in the terminal base so as to reserve more space for a thermal conductor having good conductivity. It is not necessary that terminal base 3 has one-piece structure: it can be formed by multi-pieces.

Resister 7, as shown in FIG. 1, is disposed at opening 3*c* of terminal base 3 so as to be exposed, i.e., so as to be free from any portion of terminal base 3. This allows thermal conductor 10—even being sandwiched between magnet 2 and terminal base 3—to make contact with resistor 7.

(3) Preferable Placement

Terminal base 3 is squeezed into lower case 9 so that input terminal 3*a*, terminal portion 4*d* of strip-line 4*a*, and matching capacitor 8*a* are in secure press-contact in that order; similarly, output terminal 3*b*, terminal portion 4*e* of strip-line 4*b*, and matching capacitor 8*b* are in secure press-contact in that.

(4) Input and Output Terminals

Although input and output terminals 3*a* and 3*b* of the embodiment are disposed on resin-made terminal base 3 by insert molding, they can be bonded with an adhesive to the base. As another way, it is possible to form a locking portion in terminal base 3 and alter the shape of the locking portion to mechanically fix input and output terminals 3*a* and 3*b*. Using an adhesive can reinforce the connection. Although input and output terminals 3*a* and 3*b* of the embodiment are made of a conductive metal plate through bending, they can be formed by plating or thin-film forming technique, such as spattering. In this case, input and output terminals 3*a* and 3*b* may be formed on the surface of terminal base 3, or the terminals may be formed in terminal base 3, with a part of them being exposed to the outside of the base.

Input and output terminal 3*a* and 3*b* are necessary and sufficient to terminal base 3: forming additional terminals or electrode patterns will inhibit terminal base 3 from becoming more compact and lightweight.

Now will be described heat-radiation characteristics of the non-reciprocal circuit device of the present invention. According to the embodiment, thermal conductor 10 having good conductivity is inserted into the space between magnet 2, which is attached to upper cover 1, and terminal base 3 and substrate 5. Inserted thermal conductor 10 occupies approximately 16% of the volume of the non-reciprocal circuit device. For thermal conductor 10 with good conductivity, silicon rubber sheet TC-50TXS manufactured by Shin-Etsu Silicones is employed in the embodiment. It is not limited to a sheet-type: an oil compound and vulcanized rubber can also provide the similar effect.

Although resistors 7 of the embodiment, as shown in FIG. 1, are formed of two parallel-connected resistors, less than two, or more than two resistors, or a chip resistor array can be also acceptable.

Tables 1 and 2 below give experimental evaluations showing the breakdown power and electrical characteristics—in reverse-direction input—in comparison between the embodiment of the present invention and the prior-art.

TABLE 1

Breakdown power with respect to reverse-direction input

| | Characteristics change point of the non-reciprocal circuit device | Breakdown point of the non-reciprocal circuit device |
|---|---|---|
| Prior-art | 2 W | 2.5 W |
| Embodiment | 5 W | 6.5 W |

TABLE 2

Characteristics evaluation in comparison between the embodiment and the prior-art (in a frequency band of 800 MHz at ordinary temperatures)

| Tested characteristics | Prior-art | Embodiment |
|---|---|---|
| Insertion loss (dB) | ≦0.55 | ≦0.55 |
| Isolation (dB) | ≧15 | ≧15 |
| V.S.W.R | ≦1.5 | ≦1.5 |
| The second harmonics attenuation (dB) | ≧20 | ≧20 |
| The third harmonics attenuation (dB) | ≧20 | ≧20 |

The non-reciprocal circuit device of the embodiment offers more than double the breakdown power in reverse-direction input of the prior-art device (see Table 1), maintaining the characteristics offered by the prior-art at the same level (see Table 2).

Figure 4:
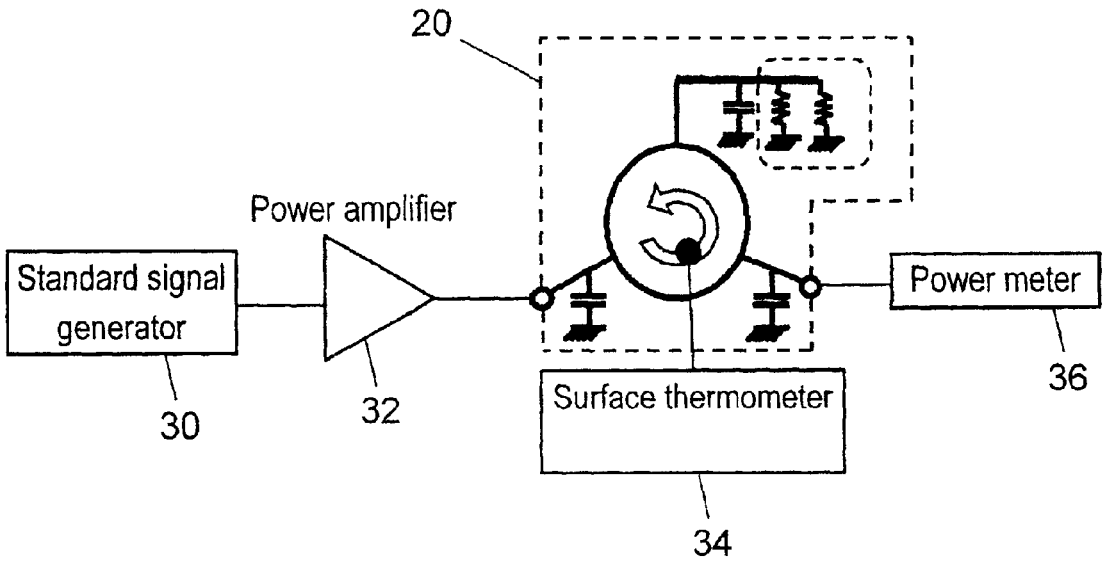
FIG. 4 shows the measurement system with respect to the surface temperature—when a signal travels in the forward direction—of the non-reciprocal circuit device of the embodiment.
Figure 5:
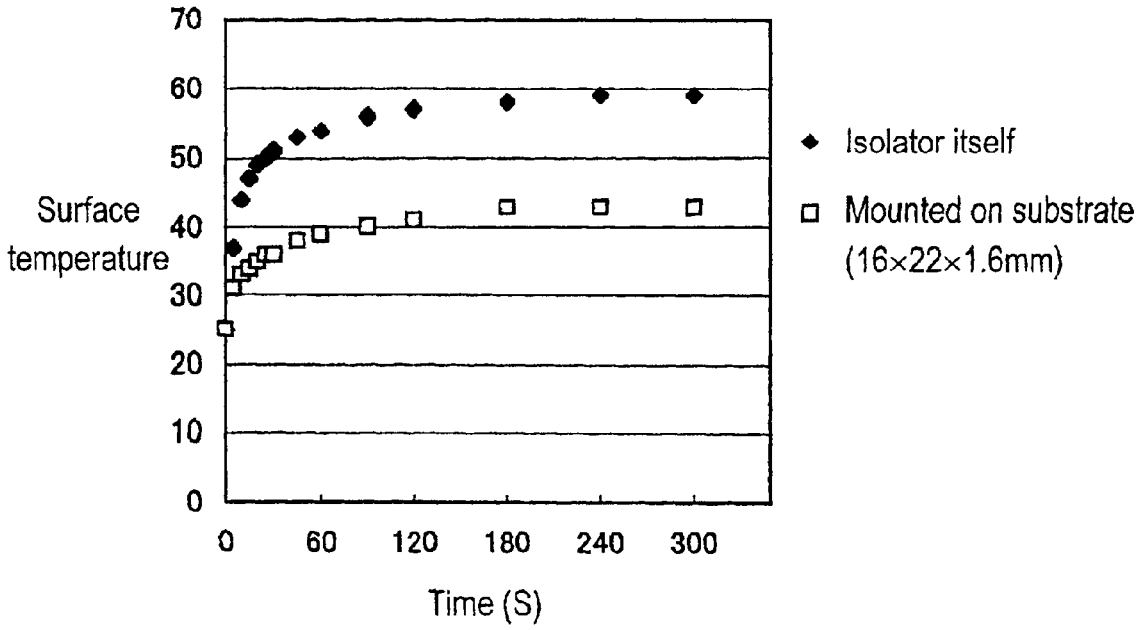
FIG. 5 shows the relation between the surface temperature of the non-reciprocal circuit device and the lapse of time in forward-direction input.

As shown in FIG. 4, when a signal from standard signal generator 30 is amplified by power amplifier 32 and fed, as forward-direction input, into device 20 under test, device 20 has a temperature of approximately 60° C.—almost the same as that of the prior-art device (see FIG. 5). The surface temperature of device 20 is measured by surface thermometer 34.

Figure 6:
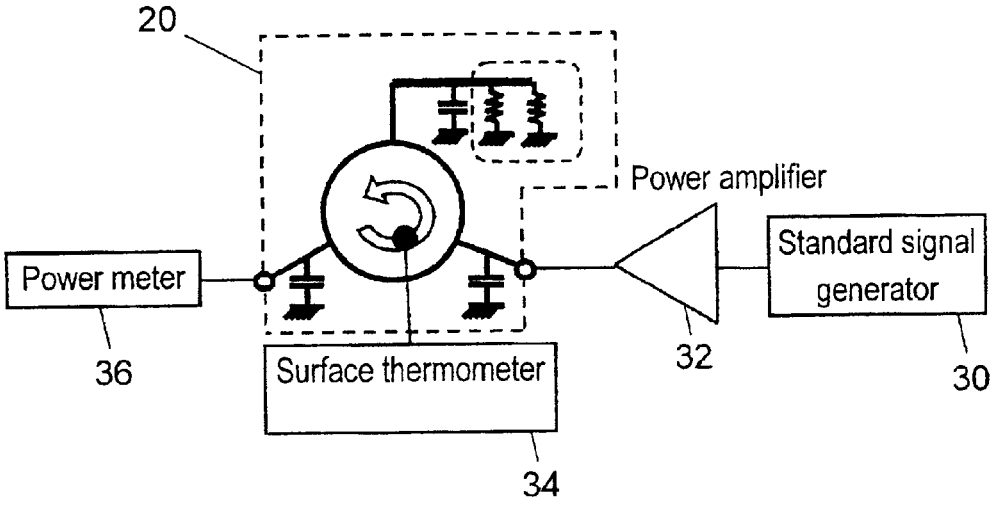
FIG. 6 shows the measurement system with respect to the surface temperature—when a signal travels in the reverse direction—of the non-reciprocal circuit device of the embodiment.
Figure 7:
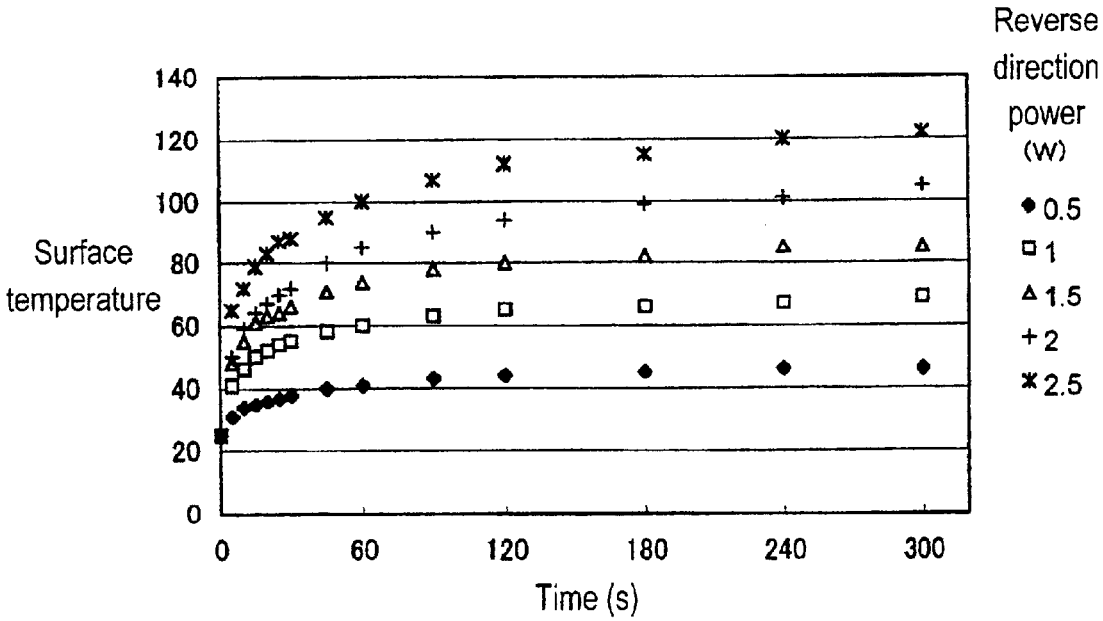
FIG. 7 shows the relation between the surface temperature of the non-reciprocal circuit device and the lapse of time in reverse-direction input.

On the other hand, as shown in FIG. 6, when a signal from standard signal generator 30 is amplified by power amplifier 32 and fed, as reverse-direction input, into device 20 under test, the temperature of device 20 stays generally not higher than 120° C., even at a maximum power of 2.5 W (see FIG. 7). The curves in FIG. 7 shows that non-reciprocal circuit device 20 does not experience an unusual rise in temperatures by which characteristics degradation of the device can occur. In FIG. 6, surface thermometer 34 measures the surface temperature and power meter 36 measures the power in reverse direction.

Figure 8:
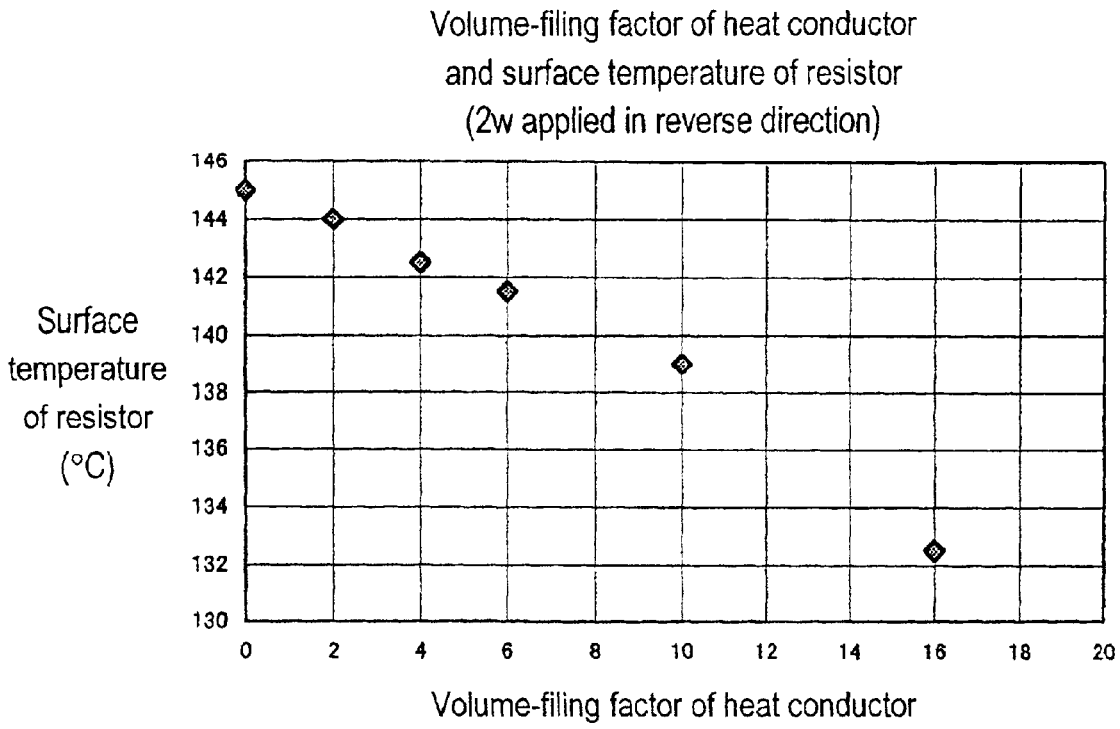
FIG. 8 shows the relation between the volume-filling factor of the thermal conductor and the surface temperature of the termination resistor in reverse-direction input of the non-reciprocal circuit device.
Figure 9:
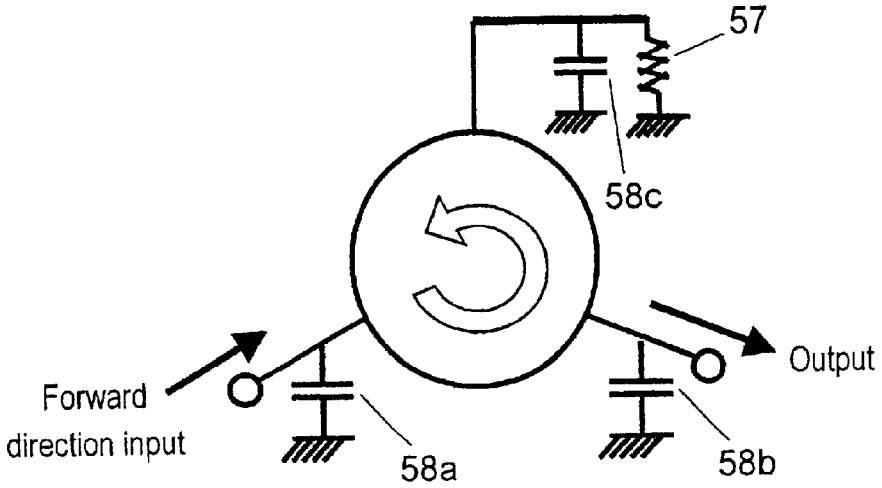
FIG. 9 PRIOR ART
FIG. 9 is a schematic diagram depicting how a typical non-reciprocal circuit device works in forward-direction input.
Figure 10:
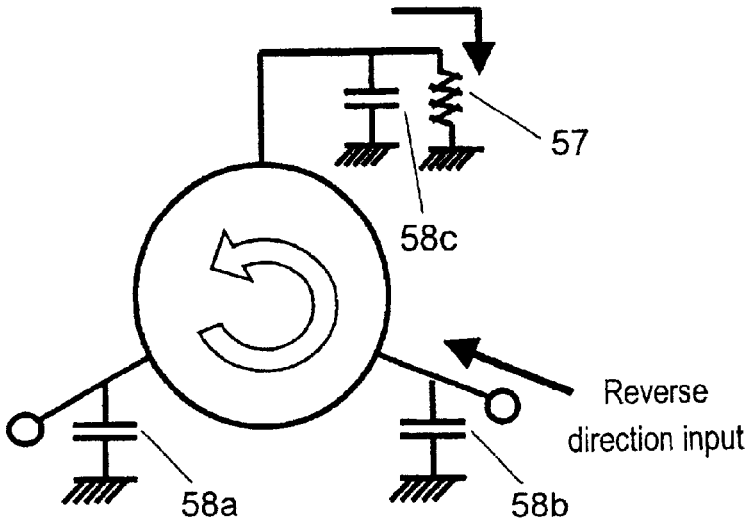
FIG. 10 PRIOR ART
FIG. 10 is a schematic diagram depicting how a typical non-reciprocal circuit device works in reverse-direction input.
Figure 11:
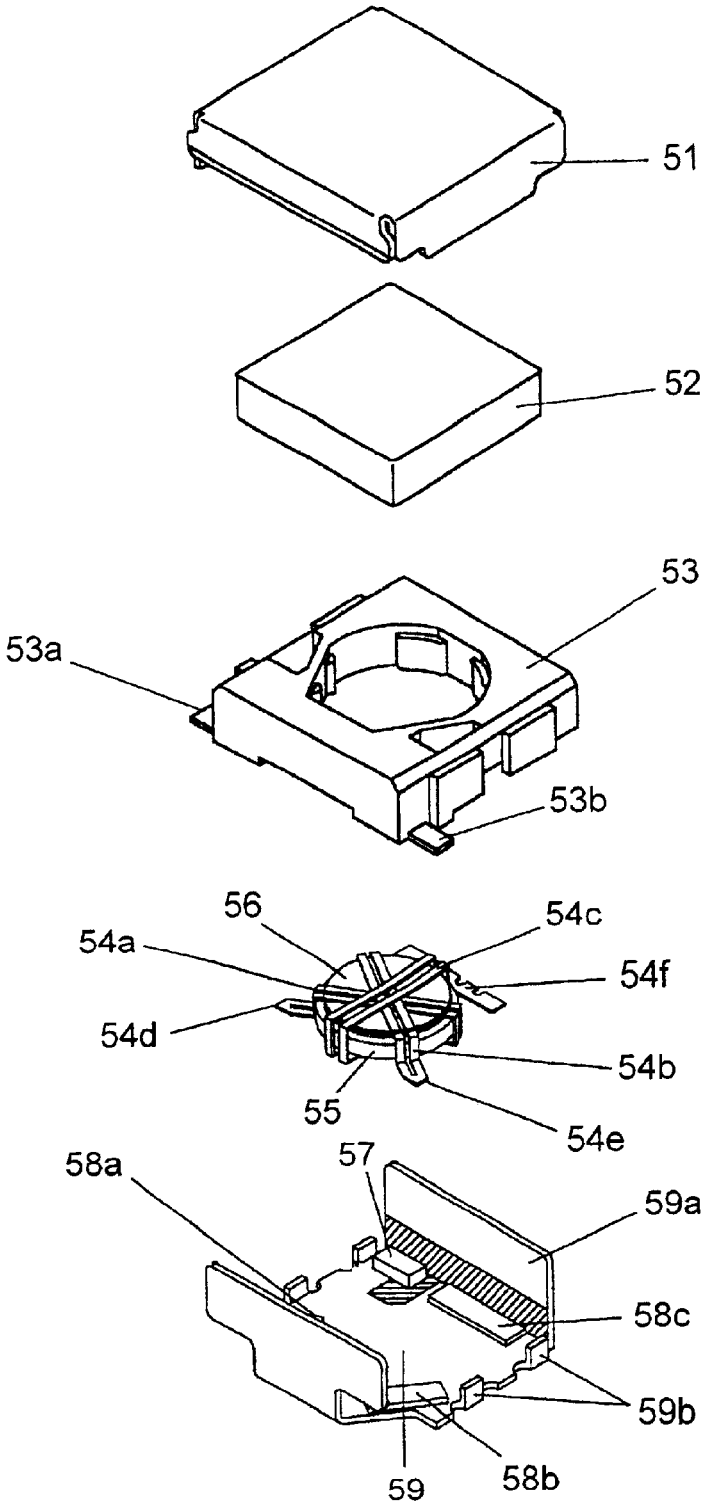
FIG. 11 PRIOR ART
FIG. 11 is an exploded perspective view of a prior-art. non-reciprocal circuit device

FIG. 8 shows the relation between the surface temperature of the resistor and the volume of the thermal conductor in device 20 when 2 W of power in reverse direction is fed into device 20. It will be understood that heat-radiation effect improves as the volume of the thermal conductor increases.

Although the embodiment introduces the non-reciprocal circuit device operating at a frequency band ranging 887 to 925 MHz (with a center frequency of 906 MHz), the non-reciprocal circuit device is not limited to the frequency band.

Besides, the device of the present invention is not limited to an isolator, but serves as a circulator. When it is used as a circulator, the thermal conductor serves as a heat-radiator for the strip-lines. Herein, the structure of the circulator is, for example, like the structure shown in FIG. 1 from which termination resistor 7 is removed.

According to the non-reciprocal circuit device of the present invention, a thermal conductor with good conductivity is disposed in the case so as to have intimate contact with the termination resistor, thereby heat generated at the resistor effectively radiates. It is thus possible to provide a non-reciprocal circuit device handling signals with high power—5 W of power in forward-direction; 2 W of power in reverse-direction, maintaining the characteristics of the prior-art downsized non-reciprocal circuit device.

What is claimed is:

1. An irreversible circuit element comprising:

(a) a magnetic substrate;

(b) a magnet applying a magnetic field to the substrate;

(c) strip-lines lying on the substrate crossing with each other at an angle and being insulated with each other;

(d) a capacitor connecting to each of the strip-lines;

(e) a termination resistor connecting to one of the strip-lines;

(f) a case accommodating the substrate, the magnet, the strip-lines, the capacitor, and the termination resistor; and (g) a thermal conductor disposed in the case, wherein heat generated at at least one of the termination resistor and the strip-lines are radiated through the thermal conductor, and wherein a portion of the thermal conductor over the termination resistor has a thickness greater than other portions of the thermal conductor.

2. The irreversible circuit element of claim 1, wherein the generated heat is transferred through the thermal conductor to at least one member included in the irreversible circuit element.

3. The irreversible circuit element of claim 1, wherein the thermal conductor is made of an insulating material.

4. The irreversible circuit element of claim 1, wherein the thermal conductor is disposed close to the termination resistor or in a contact with the termination resistor.

5. The irreversible circuit element of claim 1, wherein the thermal conductor is made of a material having any one of flexibility and elasticity.

6. The irreversible circuit element of claim 5, wherein the thermal conductor is made of a resin material.

7. The irreversible circuit element of claim 1, wherein the thermal conductor is accommodated in a cavity in the case.

8. The irreversible circuit element of claim 1, wherein the thermal conductor has a contact with at least one of the magnet and the case.

9. The irreversible circuit element of claim 1, wherein the thermal conductor having adhesion is fixed in the case.

10. The irreversible circuit element of claim 1, wherein the thermal conductor is made of one of a solid material and a material with a viscosity capable of keeping the thermal conductor within the element, not escaping the conductor out of the case.

11. The irreversible circuit element of claim 1, wherein the case further includes a terminal base for accommodating the substrate, the terminal base with which an input terminal and an output terminal for the irreversible circuit element is provided so as not to cover the termination resistor therewith.

12. The irreversible circuit element of claim 11, wherein the thermal conductor is made of an insulating material, and the thermal conductor has a volume of not less than 2% to not greater than 75% of that of the irreversible circuit element.

13. The irreversible circuit element of claim 1, wherein the terminal base has a general shape of "C" with an opening at a part of the terminal base, the opening is interconnected with the central portion of the base, and the substrate is placed at the central portion of the base.

14. An irreversible circuit element comprising:

(a) a magnetic substrate;

(b) a magnet applying a magnetic field to the substrate;

(c) strip-lines lying on the substrate crossing with each other at an angle and being insulated with each other;

(d) a capacitor connecting to each of the strip-lines;

(e) a termination resistor connecting to one of the strip-lines;

(f) a case accommodating the substrate, the magnet, the strip-lines, the capacitor, and the termination resistor; and (g) a thermal conductor disposed in the case, wherein heat generated at at least one of the termination resistor and the strip-lines are radiated through the thermal conductor, and wherein the terminal base has a general shape of "C" with an opening at a part of the terminal base, the opening is interconnected with the central portion of the base, and the substrate is placed at the central portion of the base.

15. An irreversible circuit element comprising:

(a) a magnetic substrate;

(b) a magnet applying a magnetic field to the substrate;

(c) strip-lines lying on the substrate crossing with each other at an angle and being insulated with each other;

(d) a capacitor connecting to each of the strip-lines;

(e) a termination resistor connecting to one of the strip-lines;

(f) a case accommodating the substrate, the magnet, the strip-lines, the capacitor, and the termination resistor; and (g) a thermal conductor disposed in the case, wherein heat generated at at least one of the termination resistor and the strip-lines are radiated through the thermal conductor, and wherein the thermal conductor is made of an insulating material, and the thermal conductor has a volume of not less than 2% to not greater than 75% of that of the irreversible circuit element.

16. An irreversible circuit element comprising:

(a) a magnetic substrate;

(b) a magnet applying a magnetic field to the substrate;

(c) strip-lines lying on the substrate crossing with each other at an angle and being insulated with each other;

(d) a capacitor connecting to each of the strip-lines;

(e) a termination resistor connecting to one of the strip-lines;

(f) a case accommodating the substrate, the magnet, the strip-lines, the capacitor, and the termination resistor; and (g) a thermal conductor disposed in the case, wherein heat generated at at least one of the termination resistor and the strip-lines are radiated through the thermal conductor, wherein the thermal conductor is disposed close to the termination resistor or in a contact with the termination resistor, and wherein a portion of the thermal conductor over the termination resistor has a thickness greater than other portions of the thermal conductor.

* * * * *